US007748932B2

(12) United States Patent
Lindsey

(10) Patent No.: US 7,748,932 B2
(45) Date of Patent: Jul. 6, 2010

(54) SOIL STABILIZATION AND ANCHORAGE SYSTEM

(76) Inventor: Russell Lindsey, 186 Hollisterville Highway, Moscow, PA (US) 18444

( * ) Notice: Subject to any disclaimer, the term of this patent is extended or adjusted under 35 U.S.C. 154(b) by 867 days.

(21) Appl. No.: 11/423,323

(22) Filed: Jun. 9, 2006

(65) Prior Publication Data

US 2007/0286685 A1 Dec. 13, 2007

(51) Int. Cl.
*E02D 5/00* (2006.01)

(52) U.S. Cl. ..... 405/233; 405/232; 405/240; 405/241

(58) Field of Classification Search ..... 405/233, 405/249, 250, 231, 232, 236, 240, 241, 252.1, 405/254

See application file for complete search history.

(56) References Cited

U.S. PATENT DOCUMENTS

| | | | | | |
|---|---|---|---|---|---|
| 3,115,226 | A | | 12/1963 | Thompson, Jr. | |
| 3,961,671 | A | | 6/1976 | Adams et al. | |
| 3,999,391 | A | * | 12/1976 | Meredith | 405/259.5 |
| 4,009,582 | A | | 3/1977 | LeCorgne | |
| 4,492,493 | A | | 1/1985 | Webb | |
| 4,678,373 | A | | 7/1987 | Langenbach, Jr. | |
| 4,756,129 | A | | 7/1988 | Webb | |
| 4,998,849 | A | | 3/1991 | Summers | |
| 5,066,168 | A | * | 11/1991 | Holdeman | 405/249 |
| 5,122,013 | A | * | 6/1992 | Junsheng et al. | 405/237 |
| 5,256,004 | A | * | 10/1993 | Gemmi et al. | 405/237 |
| 5,417,522 | A | * | 5/1995 | Kono et al. | 405/266 |
| 5,458,209 | A | * | 10/1995 | Hayes et al. | 175/61 |
| 5,542,786 | A | * | 8/1996 | Blum | 405/240 |
| 5,560,739 | A | * | 10/1996 | Kunito | 405/237 |
| 5,575,593 | A | | 11/1996 | Raaf | |
| 5,707,180 | A | | 1/1998 | Vickars et al. | |
| 5,904,447 | A | | 5/1999 | Sutton et al. | |
| 5,919,005 | A | | 7/1999 | Rupiper | |
| 5,934,836 | A | | 8/1999 | Rupiper et al. | |
| 6,109,836 | A | * | 8/2000 | Gritti | 405/266 |
| 6,264,402 | B1 | | 7/2001 | Vickars et al. | |
| 6,435,776 | B2 | | 8/2002 | Vickars et al. | |
| 6,503,024 | B2 | | 1/2003 | Rupiper | |
| 6,615,554 | B2 | | 9/2003 | Rupiper | |
| 6,652,195 | B2 | | 11/2003 | Vickars et al. | |
| 6,722,821 | B1 | | 4/2004 | Perko et al. | |
| 7,004,683 | B1 | | 2/2006 | Rupiper | |
| 2004/0028480 | A1 | * | 2/2004 | Verstraeten | 405/233 |

* cited by examiner

*Primary Examiner*—Tara Mayo-Pinnock
*Assistant Examiner*—Benjamin Fiorello
(74) *Attorney, Agent, or Firm*—Mitchell A. Smolow

(57) ABSTRACT

This invention relates to a system and method for use in stabilizing different types of soils and/or creating anchorage and more particularly, to a system and method for injecting various types of solidifying material into a subsurface through a drilling apparatus during the drilling operation. The drilling apparatus may be removable and reusable used to create a micro or mini pile for soil stabilization, or alternatively it can be left in place to be used in conjunction with grout and similar materials for forming an anchor or load carry pier. A solidifying material swivel, a drive connector and a drilling apparatus, in combination are attached to a power drive unit. In one preferred embodiment, the drilling apparatus remains within the soil subsurface, encased in solidifying material. In another preferred embodiment, the drilling apparatus is removed leaving a homogenous pile of solidifying material behind.

24 Claims, 7 Drawing Sheets

SOIL STABILIZATION AND ANCHORAGE SYSTEM

FIELD OF THE INVENTION

This invention relates to a system and method for use in stabilizing different types of soils and/or creating anchorage and more particularly, but not by way of limitation, to a system and method for injecting various types of solidifying material into a subsurface through a drilling apparatus during the drilling operation. The drilling apparatus may be removable and reusable, used to create a micro or mini pile for soil stabilization or alternatively it can be left in place to form an anchor or load carry pier.

BACKGROUND OF THE INVENTION

Soil stabilization techniques such as helical plate bearing anchors, mini-piles and micro-piles are known. For example, helical plate bearing anchors are mounted on steel bar shafts and pipe shafts with plate helices that are drilled into soil and used as tension, compression and lateral force resisting members. These types of anchors may be mounted to hollow shafts to provide a channel for injecting solidifying material into the subsurface after drilling is completed. For example, hollow drill rods and drill shafts are used with grout in forming tiebacks, mini-piles, rock anchors, soil nails and other micro-pile uses.

Further, various types of auger tools are used for excavating holes. This type of tool may have a disposable drill head. Flight augers have continuous helices along the length of the shaft. Because of the expense of this type of auger, the auger is generally removed from a drill hole and not left in place, the drill hole subsequently filled with solidifying material to form a mini-pile.

In U.S. Pat. No. 5,575,593 to Raaf, a method and apparatus for installing a helical pier with pressurized grouting is disclosed. An anchor having helices is rotated into the ground. The helical anchor is hollow and includes multiple perforated holes along its length and about its perimeter. After the anchor is drilled into the ground, pressurized grout is injected therein and forced out the perforated holes.

In U.S. Pat. No. 4,009,582 to LeCorgne, a method is described for forming a caseless concrete pile using a hollow pipe, a connector and a tubular driving mandrel. In U.S. Pat. No. 3,512,366 to Turzillo, a hollow auger for drilling holes is disclosed. The auger described in the Turzillo patent is withdrawn from the hole leaving a steel rod with drill bit in place with concrete thereafter poured for forming a concrete pier.

In U.S. Pat. Nos. 4,492,493 and 4,756,129 to Webb and U.S. Pat. No. 3,115,226 to Thompson, Jr. different types of ground anchors and apparatus are described. Also, U.S. Pat. No. 4,998,849 to Summers, U.S. Pat. No. 3,961,671 to Adams et al. and U.S. Pat. No. 4,678,373 to Langenbach, Jr. disclose different types of driving apparatus and methods of shoring structures.

Other varieties of ground anchor devices used for soil stabilization have been described. In particular, U.S. Pat. No. 6,722,821 to Perko et al. and U.S. Pat. Nos. 5,904,447, 5,919,005 and 5,934,836 to Rupiper et al. disclose recent anchor devices using helical piers for stabilizing soil and for securing building foundations and other structures.

The above described and other known soil stabilization and anchoring techniques include either pumping a solidifying material under pressure through a hollow drilling apparatus and out holes contained therein once the drilling apparatus has been advanced into the ground subsurface, or alternatively, withdrawing the drilling apparatus and thereafter pumping a solidifying material under pressure into the space created by the drilling apparatus. Unfortunately, such post-drilling operation techniques leave voids both within the solidifying material and between the solidifying material and soil with resulting loss of soil stabilization and resistance to displacement.

Accordingly, there is still a continuing need for improved system designs that result in voidless solidifying material placement. In presenting a novel way to deliver the solidifying material during the drilling process, the present invention fulfills this need and further provides related advantages.

BRIEF SUMMARY OF THE INVENTION

The soil stabilization and anchoring system and method of the present invention teaches the unique combination of structure and functions to allow a solidifying material to be pumped under pressure during the drilling process, thereby preventing voids both within the solidifying material and between the solidifying material and soil, resulting in increased soil stabilization and resistance to displacement.

In one embodiment, the present invention comprises three major components: a solidifying material swivel, a drive connector and a drilling apparatus. In one preferred embodiment, the drilling apparatus remains within the soil subsurface, encased in solidifying material. In another preferred embodiment, the drilling apparatus is removed leaving a homogenous pile of solidifying material behind.

The drilling apparatus includes at least one hollow pipe section. In a first embodiment, at least one helice is attached to the pipe section. The helice is used for driving the pipe section into the ground and for additional resistance to displacement forces once the drilling is completed. At least one perforation in the pipe section is used for introducing a solidifying material under pressure into the soil subsurface during the drilling process. The solidifying material is pumped under pressure using the solidifying material swivel while the drilling apparatus is being operatively engaged. The drilling apparatus remains in the soil encased in solidifying material to increase soil stabilization and/or create an anchor point or load carry pier.

In a second embodiment, after drilling to a predetermined depth, the drilling apparatus is withdrawn, all the while having a solidifying material pumped under pressure both during the drilling and withdrawal process. In this manner, a voidless pile remains for soil stabilization.

In all embodiments, an upper end of the drilling apparatus attaches to a drive connector allowing for operative attachment of the solidifying material swivel to the drilling apparatus. The solidifying material swivel comprises a drive shaft which extends through a stationary casing at both ends and is adapted at an upper end to accept a power driving device, for example, various types of torque, hydraulic and percussion drives for drilling into different types of soils. A lower end of the drilling apparatus includes components used for advancing downwardly into the soil, for example, a cutter head, a helix, a drill point and the like.

One advantage of the present invention is that it provides a system which is adaptable for injecting solidifying material during the drilling process into a soil subsurface thereby achieving voidless soil stabilization, load carrying and anchorage.

Another advantage of the invention is that the drilling apparatus can be driven into the ground surface using easily interchangeable types of torque, hydraulic and percussion drilling machines.

Yet another advantage of the invention is that it provides a rugged yet relatively inexpensive drilling system that can be used interchangeably to form either a voidless anchor, load carry pier or pile.

Still another advantage of the invention is that the system allows for rapid, stable and uniform construction of voidless anchors, load carry piers or piles on all types of terrain and soil conditions.

Other features and advantages of the present invention will be apparent from the following more detailed description of the preferred embodiments taken in conjunction with the accompanying drawings which illustrate, by way of example, the principles of the invention.

DETAILED DESCRIPTION OF THE INVENTION

It is to be understood that while grout is the solidifying material of choice, the present invention is not limited to use with grout. Rather, it should be apparent that any solidifying material capable of being pumped under pressure may be used. As used herein, the term "drilling apparatus" is meant to included all shafts, drills, bits, tools and the like capable of expressing solidifying material during the drilling process, be it during insertion of the drilling apparatus, during removal of the apparatus, or both.

Figure 1:
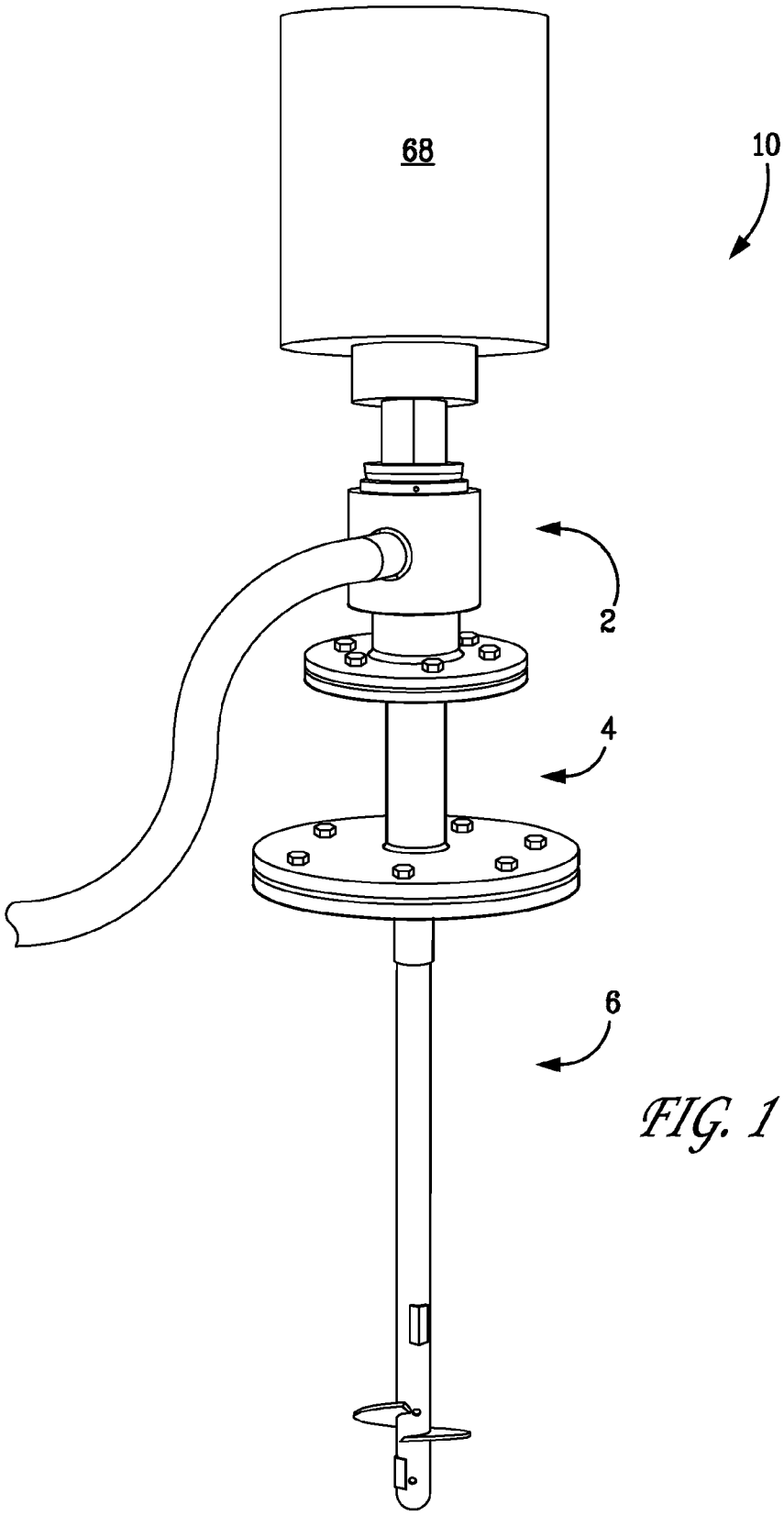
FIG. 1 is an oblique view of the swivel, drive connector and drilling apparatus, in combination.

Referring to FIG. 1, in a preferred embodiment, the soil stabilization and anchorage system of the present invention 10 comprises three main components: a solidifying material swivel 2 for receiving both a power drive unit 68 and a solidifying material (not shown), a drive connector 4 operatively connected to the solidifying material swivel 2, and a drilling apparatus 6 operatively connected to the drive connector 4.

Figure 2:
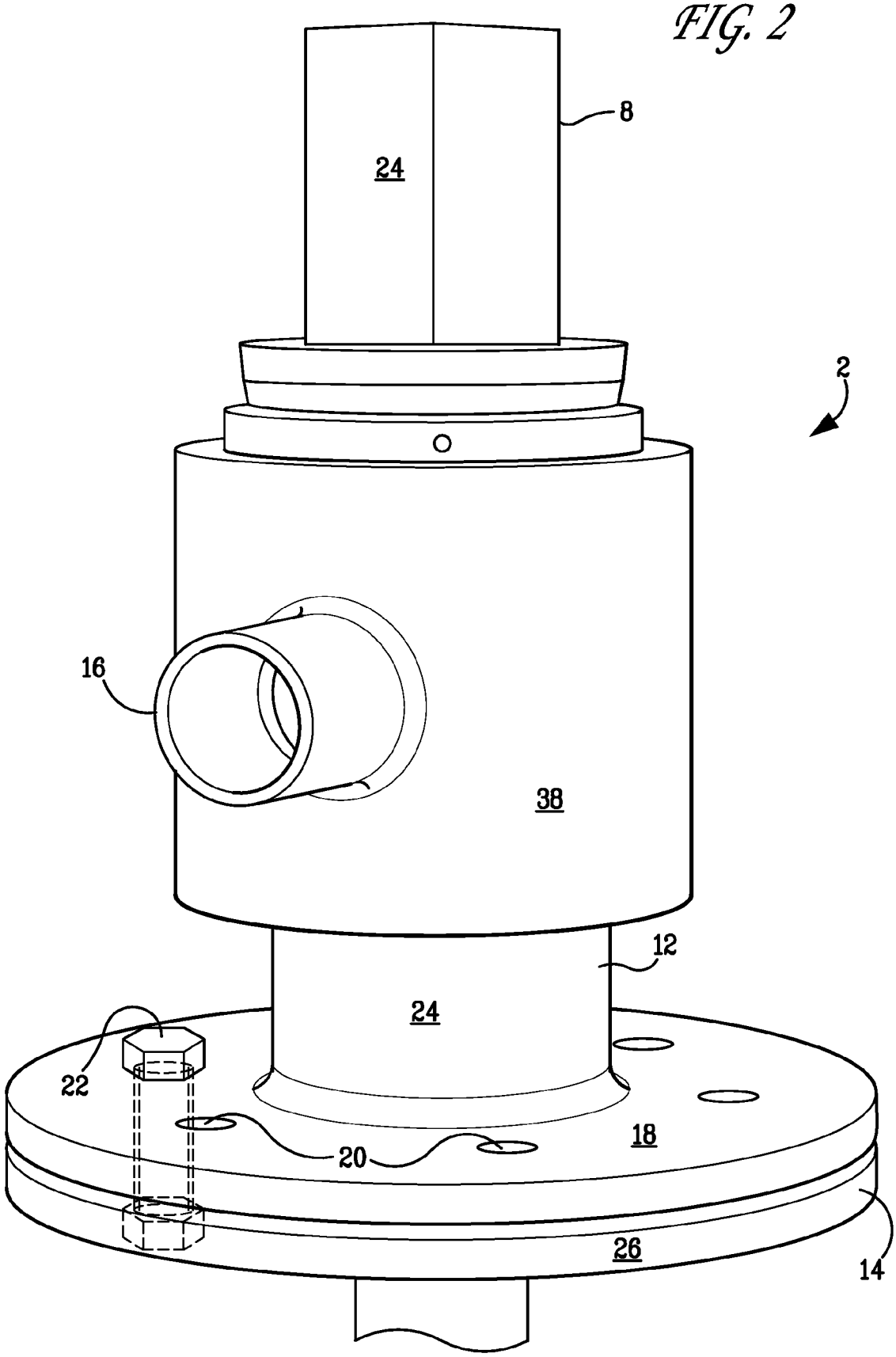
FIG. 2 is an oblique view of the swivel.
Figure 3:
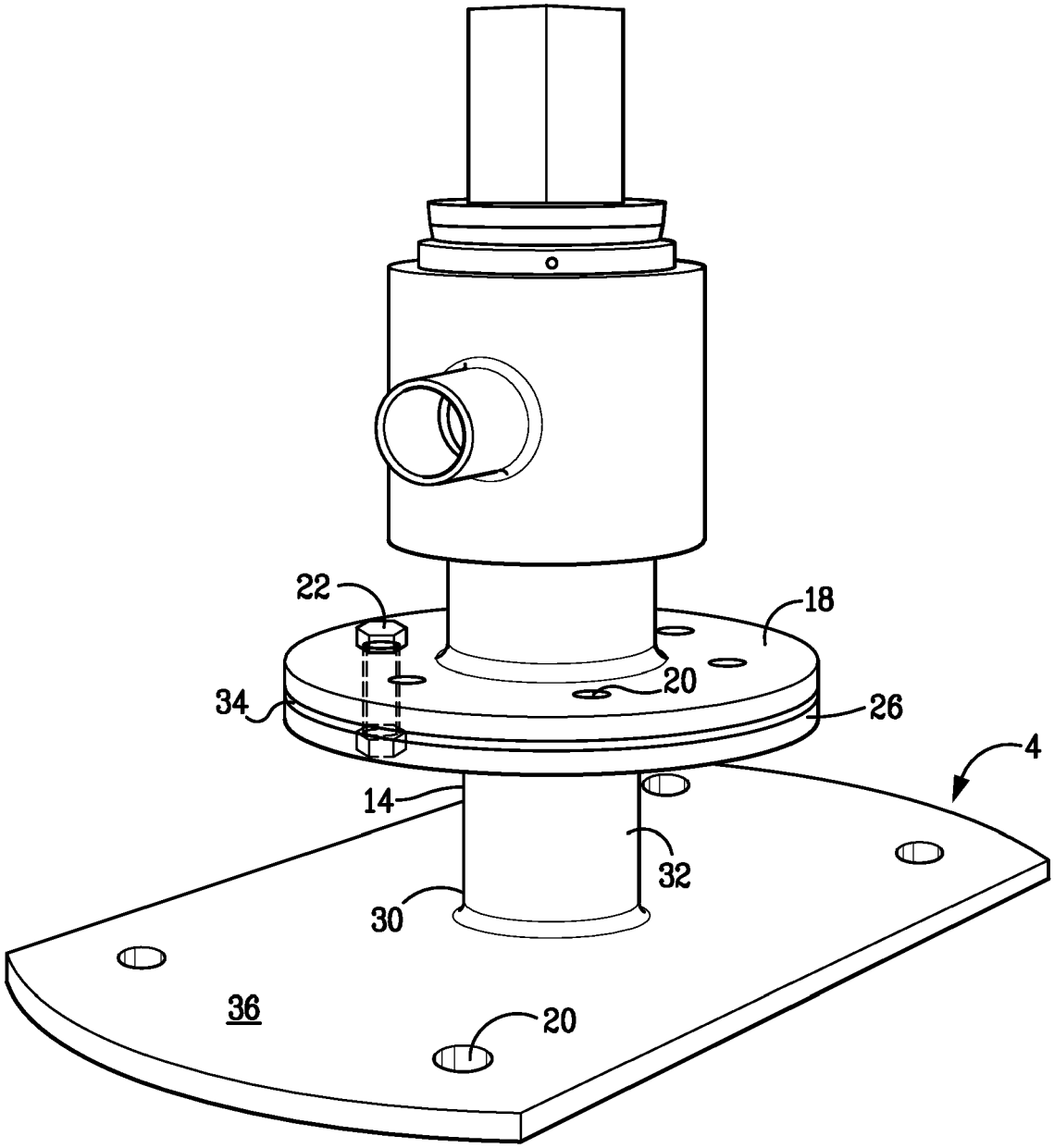
FIG. 3 is an oblique view of the swivel attached to a drive connector with a second end plate.

Turning to FIGS. 2 and 3, solidifying material swivel, for example, grout swivel 2, has a first end 8 for operatively mating with power drive unit 68, for example, a rotary torque drive, a percussion drill, a jacking apparatus, a vibratory driving device, a hydraulic drill, and like drilling equipment. A second end 12 is fabricated to operatively mate with drive connector first end 14. In a preferred embodiment, swivel second end 12 attaches to swivel plate 18 for operative mating to drive connector first end plate 26. At least one hole 20 is fabricated into plates 18 and 26 for receiving fastener 22, for example, a bolt or pin.

Intake 16 is fabricated to receive a pressurized supply of solidifying material, for example, grout, concrete or polymer (not shown). Grout swivels are well known in the art, generally comprising a grout intake port feeding into a sealed casing which surrounds a drive shaft. A portion of the drive shaft within the casing is hollow with perforations to allow the grout to pass from the casing to the hollow portion of the drive shaft. The top of the drive shaft is blocked, while the bottom is open, thereby allowing the grout to exit through the rotating drive shaft while the casing remains stationary. The novel feature of swivel 2 used in the present invention is its adaptation for use in combination with the other components of the system described in detail below. In a preferred embodiment, swivel drive shaft 24 extends beyond swivel casing 38 to form swivel second end 12.

Drive connector 4 comprises first end 14 and second end 30 separated by shaft 32. In a preferred embodiment, drive connector first end 14 attaches to drive connector first end plate 26 for operative connection to grout swivel plate 18 and drive connector second end 30 attaches to drive connector second end plate 36 for operative connection to drilling apparatus 6 having a connector plate for example, a composite pier upper pierhead plate (56, FIG. 5) (described below). At least one hole 20 is fabricated into plates 18, 26, 36 and 56 for receiving a fastener 22, for example, a bolt or pin. Drive connector shaft 32 is hollow for throughput transmission of solidifying material. Optional gasket 34 may be inserted between plates 18 and 26 and/or between 36 and 56 to control solidifying material seepage.

In another preferred embodiment shown in FIG. 4, drive connector second end 30 is adapted to operatively mate with drilling apparatus 6 (FIG. 6) having a straight shaft end, for example, a conventional helical pier or straight shaft tool (both described below). Drive connector second end 30 operatively couples with the straight shaft end drilling apparatus in a known manner such as that described in U.S. Pat. No. 6,615,554 to Rupiper, incorporated by reference. In all other aspects, drive connector 4 is as described above.

Alternatively, swivel second end 12 may be fabricated to terminate in the drive connector manners described above to directly operatively mate with drilling apparatus 6, thereby eliminating the need for drive connector 4. Of course, the advantage of drive connector 4 is the cost savings associated with fabrication of multiple drive connectors 4 to fit differing drilling apparatus 6, rather than multiple sizes of the more expensive to fabricate swivel 2.

Figure 5:
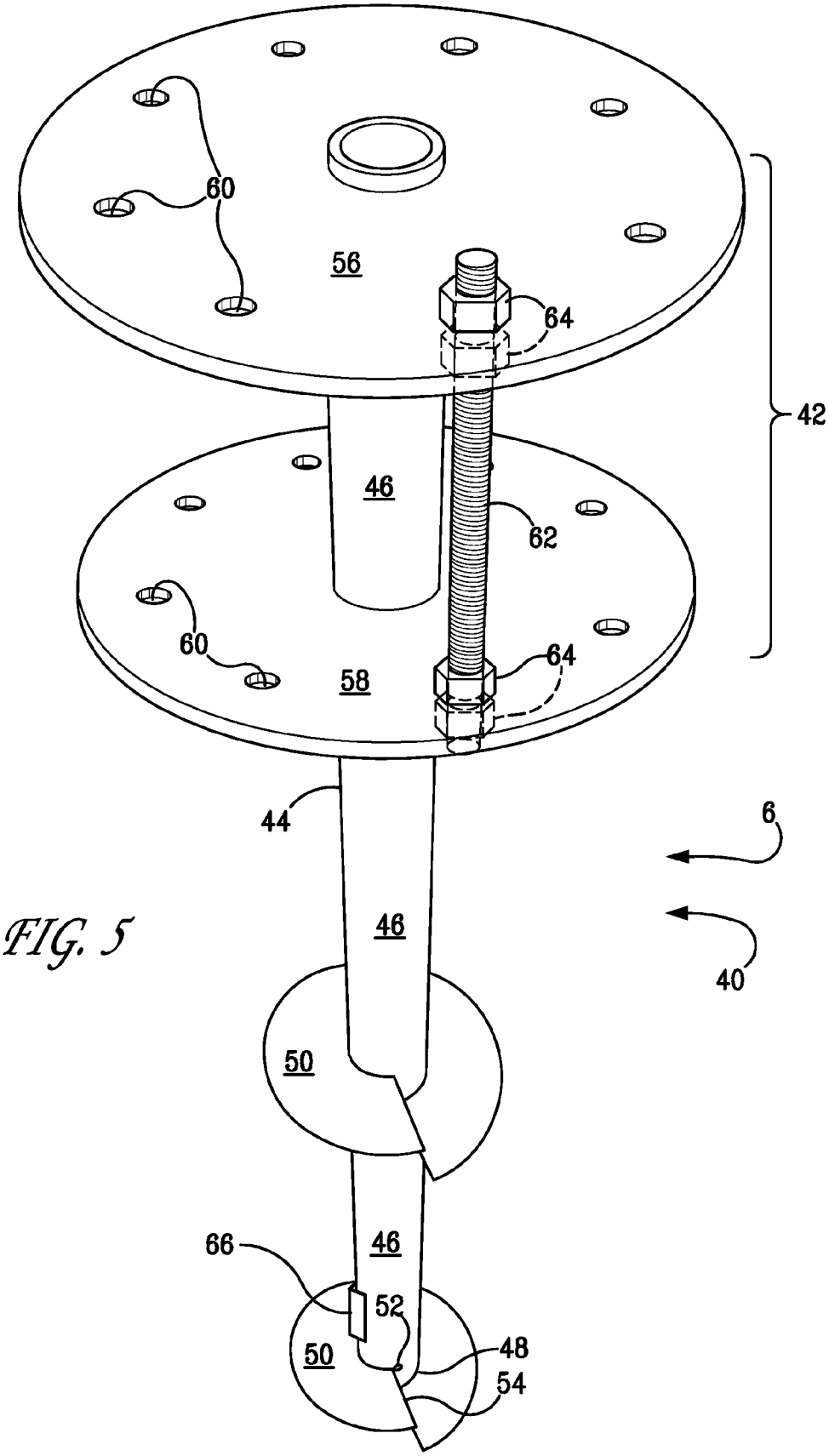
FIG. 5 is an oblique view of one form of a composite pier used as a drilling apparatus.

FIG. 5 shows one form of a composite pier 40 used as the drilling apparatus 6 in a preferred embodiment of the present invention. As used herein, the term "composite pier" is meant to include all drilling apparatus having an assembly 42 substantially at surface level upon which an above ground structure (not shown) may be mounted or anchored.

Assembly 42 is shown mounted to helical pier top portion 44 of known hollow helical pier shaft 46 having a sealed bottom end 48. Pier shaft 46 includes at least one helice 50 for advancing pier shaft 46 into a ground surface (not shown) and orifice 52 for expressing solidifying material. In a preferred embodiment, orifice 52 is fabricated directly behind helice trailing edge 54 and at least one compaction fin 66 is attached to pier shaft 46. As used herein, the term "compaction fin" is meant to include any attachment mounted to pier shaft 46 which during the drilling process creates a space around the pier shaft 46 in which the solidifying material can flow (described further below).

Assembly 42 includes upper pierhead plate 56, preferably a circular plate, mounted to pier shaft 46. Lower pierhead plate 58, preferably a circular plate, is also mounted to pier shaft 46. Pierhead plates 56 and 58 are spaced apart and are preferably fixedly attached, for example, welded, to pier shaft 46.

Pierhead plates 56 and 58 include bolt holes 60 disposed around their outer circumference. Bolt holes 60 are used to receive a portion of threaded rods 62. Plurality of nuts 64 are threaded on rods 62 for securing rods 62 to pierhead plates 56 and 58.

Bolt holes 20 of drive connector second end plate 36 (FIG. 3) are indexed above assembly bolt holes 60. An upper portion of the threaded rod 62 is received through drive connector bolt holes 20. Nuts 64 secure drive connector to assembly 42. Threaded rods 62 are shown disposed around the outer circumference of drive connector second end plate 36. Obviously, any number of threaded rods 62 and nuts 64 can be used with assembly 42 depending on the load conditions placed on drilling apparatus 6.

Figure 6:
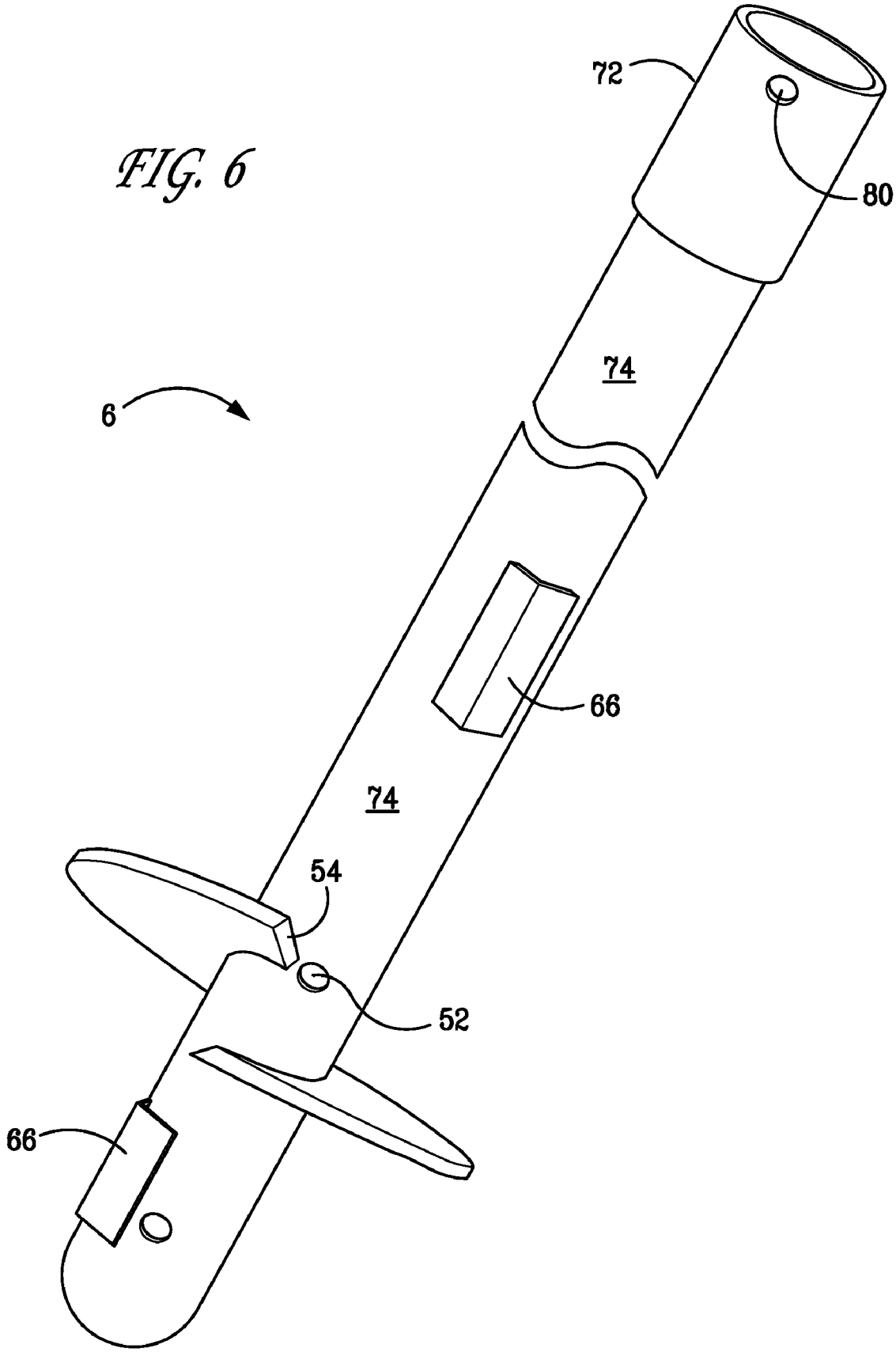
FIG. 6 is an oblique view of one form of a drilling tool used as a drilling apparatus.

FIG. 6 shows one example of a conventional helical pier or drilling tool used as the drilling apparatus 6 in another preferred embodiment of the present invention. As used herein, the term "conventional helical pier" is meant to include all drilling apparatus having a straight shaft substantially at or above surface level and the term "drilling tool" is meant to include all drilling apparatus which are not left in the ground.

Figure 7:
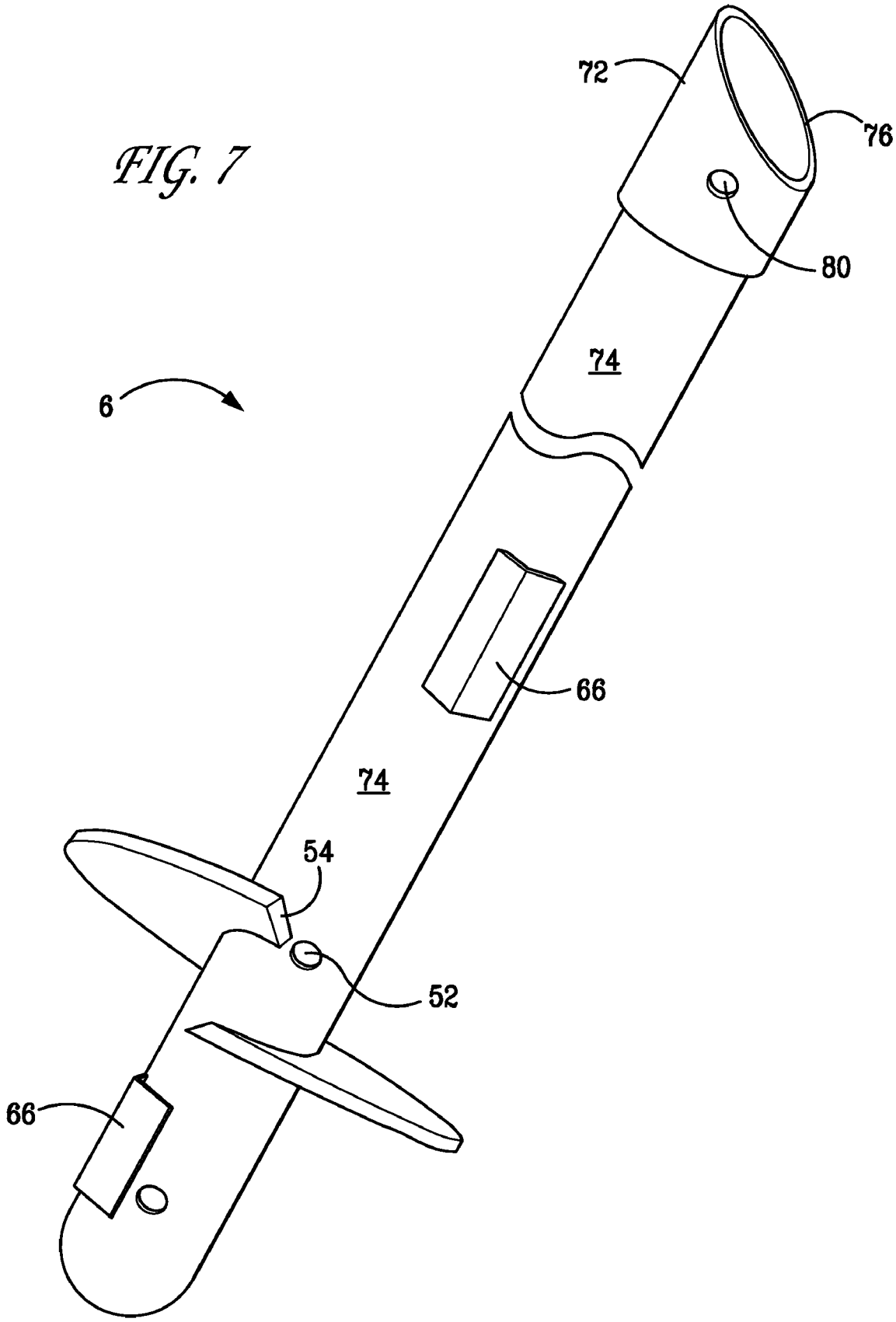
FIG. 7 is an oblique view of one form of a drilling tool used as a drilling apparatus having a diagonal cut first end.

Drive connector second end 30 (FIG. 4) forms collar 70 which receives upper end 72 of drilling apparatus shaft 74. Optionally, shaft upper end 72 includes a diagonal cut 76 (FIG. 7) received by optional mating diagonal stop 78 fabricated within collar 70 (FIG. 4). Diagonal cut 76 can be cut at an angle of about 5 to about 60 degrees perpendicular to a center line along a length of shaft 74. In this manner of coupling, the ability to apply increased torque along the length of shaft 74 is greatly improved when driving drilling apparatus 6 into the ground surface.

Figure 4:
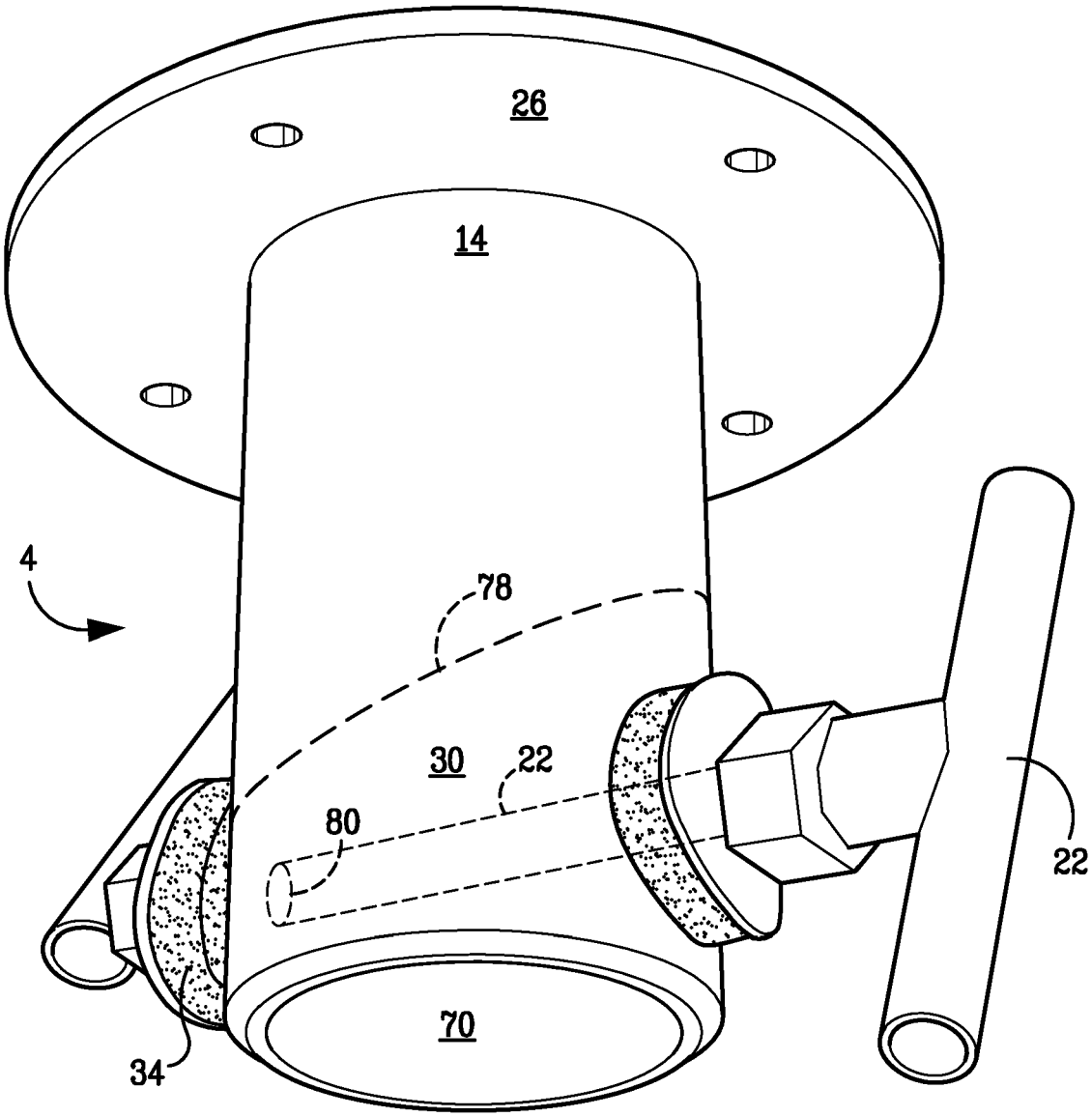
FIG. 4 is an oblique view of the drive connector with a second end collar.

Optionally, upper end 72 includes one or more holes 80, as does collar 70 (FIG. 4). Holes 80 are fabricated to align to receive fastener 22, for example, a bolt or pin, used to retain drive connector 4 to upper end 72, and to further prevent rotation of shaft 74 within collar 70. Optionally, shaft 74 and mating collar 70 have an octagonal or other geometric configurations to further aid in preventing rotation of shaft 74 within collar 70.

In use, the present inventions operates as follows: After selecting drilling apparatus 6, swivel 2 is attached to a power drive unit. Drive connector 4 having first 14 and second 30 ends capable of operably mating to swivel 2 and drilling apparatus 6 respectively, is selected and attached to swivel 2. Thereafter, drilling apparatus is attached to drive connector 4 and a solidifying material supply hose is attached to swivel solidifying material intake.

Solidifying material is pumped under pressure throughout the drilling operation, preferably the entire drilling operation. If a drilling tool is being used to create a pile to improve ground conditions, the solidifying material is also pumped during tool removal. Although the present invention may be used without limitation to pumping pressures (other than seal and connection tolerances), preferably, the solidifying material is delivered with a pumping pressure of less than about 500 lbs psi and more preferably with a pumping pressure of about 100 to 200 lbs psi and most preferably with a pumping pressure of about 150 lbs psi.

Delivering solidifying material throughout the drilling procedure as taught by the present invention prevents the solidifying material voids found with known technology. Furthermore, when used with drilling apparatus comprising a pier having an orifice located directly behind a helice trailing edge, in combination with a compaction fin, the present invention creates a column of solidifying material completely encasing the pier shaft, resulting in significant improvements to soil stabilization and anchorage over previously known methods.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A soil stabilization and anchorage system comprising:

a solidifying material swivel having a first end for operatively receiving a power drive unit, a second end for operatively receiving a hollow drive connector, and a swivel casing therebetween having a solidifying material intake port for stationaryly receiving a supply of solidifying material during a drill insertion process, wherein a swivel drive shaft extends beyond the swivel casing to form the swivel second end;

the hollow drive connector having a first end operatively connected to the solidifying material swivel and a second end for operatively receiving a drilling apparatus; and a hollow drilling apparatus having at least one orifice fabricated into a shaft for expressing a solidifying material during the drill insertion process.

2. The system of claim 1 wherein the solidifying material swivel second end comprises a swivel plate for operative mating to a drive connector first end plate and a drive connector second end plate operatively receives a drilling apparatus connector plate.

3. The system of claim 2 wherein the swivel plate and drive connector first end plate and the drive connector second end plate and drilling apparatus connector plate each have at least one hole aligned to receive a fastener.

4. The system of claim 3 further comprising a gasket positioned between at least one of the swivel plate and drive connector first end plate and the drive connector second end plate and drilling apparatus connector plate.

5. The system of claim 1 wherein the solidifying material swivel second end comprises a swivel plate for operative mating to a drive connector first end plate and the drive connector second end is adapted to operatively mate with a straight shafted drilling apparatus.

6. The system of claim 5 wherein the drive connector second end comprises a collar fabricated to operatively receive an upper end of the straight shafted drilling apparatus.

7. The system of claim 6 wherein the collar comprises a diagonal stop fabricated within the collar to operatively receive a mating diagonal cut fabricated into the upper end.

8. The system of claim 7 wherein the upper end and collar each includes a hole aligned to receive a fastener.

9. The system of claim 8 wherein the upper end and collar are fabricated into a mating geometric configuration.

10. The system of claim 1 wherein the drilling apparatus is an apparatus selected from the group consisting of a composite pier, a conventional helical pier, and a drilling tool.

11. The system of claim 1 wherein the solidifying material is a material selected from the group consisting of grout, concrete and polymer.

12. The system of claim 1 wherein the at least one orifice is located directly behind a helice trailing edge in combination with a compaction fin; the helice and compaction fin being attached to the drilling apparatus shaft.

13. A soil stabilization and anchorage system comprising:

a solidifying material swivel having a first end for operatively receiving a power drive unit, a second end for operatively receiving a drilling apparatus, and a swivel casing therebetween having a solidifying material intake port for stationaryly receiving a supply of solidifying material during a drill insertion process, wherein a swivel drive shaft extends beyond the swivel casing to form the swivel second end; and a hollow drilling apparatus having at least one orifice fabricated into a shaft for expressing a solidifying material during the drill insertion process;

wherein the drilling apparatus is an apparatus selected from the group consisting of a composite pier, a conventional helical pier, and a drilling tool; the solidifying material is a material selected from the group consisting of grout, concrete and polymer; and the at least one orifice is located directly behind a helice trailing edge in combination with a compaction fin; the helice and compaction fin being attached to the drilling apparatus shaft.

14. The system of claim 13 wherein the solidifying material swivel second end comprises a swivel plate for operative mating to a drilling apparatus connector plate.

15. The system of claim 14 further comprising a gasket positioned between the swivel plate and the drilling apparatus connector plate.

16. The system of claim 13 wherein the solidifying material swivel second end is adapted to operatively mate with a straight shafted drilling apparatus.

17. The system of claim 16 wherein the solidifying material swivel second end comprises a collar fabricated to operatively receive an upper end of the straight shafted drilling apparatus.

18. The system of claim 17 wherein the collar comprises a diagonal stop fabricated within the collar to operatively receive a mating diagonal cut fabricated into the upper end.

19. A method of placing a soil stabilization and anchorage system comprising the steps of:

a. operatively attaching a power drive unit to a solidifying material swivel;

b. operatively attaching the solidifying material swivel to a hollow drilling apparatus, wherein;

the solidifying material swivel includes a first end for operatively receiving the power drive unit, a second end for operatively receiving the drilling apparatus, and a swivel casing therebetween having a solidifying material intake port for stationaryly receiving a supply of solidifying material during a drill insertion process, wherein a swivel drive shaft extends beyond the swivel casing to form the swivel second end; and the hollow drilling apparatus includes at least one orifice fabricated into a shaft for expressing a solidifying material during the drill insertion process;

b. inserting the drilling apparatus into a ground substrate;

c. feeding a pressurized supply of solidifying material through the stationary intake port during the drill insertion process such that the solidifying material is pumped during the drill insertion process and expressed through the at least one orifice to create a substantially voidless column of solidifying material encasing the shaft; and d. disengaging the solidifying material swivel from the drilling apparatus.

20. The method of claim 19 further including the step of withdrawing the drilling apparatus from the ground substrate while feeding a pressurized supply of solidifying material through the intake port during the withdrawal such that the solidifying material is pumped during the withdrawal and expressed through the at least one orifice to leave a substantially voidless column of solidifying material within the ground substrate.

21. The method of claim 19 wherein the drilling apparatus is an apparatus selected from the group consisting of a composite pier, a conventional helical pier, and a drilling tool; the solidifying material is a material selected from the group consisting of grout, concrete and polymer; and the at least one orifice is located directly behind a helice trailing edge in combination with a compaction fin; the helice and compaction fin being attached to the drilling apparatus shaft.

22. A method of placing a soil stabilization and anchorage system comprising the steps of:

a. operatively attaching a power drive unit to a solidifying material swivel;

b. operatively attaching the solidifying material swivel to a hollow drive connector;

c. operatively attaching the hollow drive connector to a hollow drilling apparatus, wherein;

the solidifying material swivel includes a first end for operatively receiving the power drive unit, a second end for operatively receiving the hollow drive connector, and a swivel casing therebetween having a solidifying material intake port for stationaryly receiving a supply of solidifying material during a drill insertion process, wherein a swivel drive shaft extends beyond the swivel casing to form the swivel second end;

the hollow drive connector includes a first end operatively connected to the solidifying material swivel and a second end for operatively receiving the drilling apparatus; and the hollow drilling apparatus includes at least one orifice fabricated into a shaft for expressing a solidifying material during the drill insertion process;

d. inserting the drilling apparatus into a ground substrate;

e. feeding a pressurized supply of solidifying material through the stationary intake port during the drill insertion process such that the solidifying material is pumped during the drill insertion process and expressed through the at least one orifice to create a substantially voidless column of solidifying material encasing the shaft; and f. disengaging the solidifying material swivel from the drilling apparatus.

23. The method of claim 22 further including the step of withdrawing the drilling apparatus from the ground substrate while feeding a pressurized supply of solidifying material through the intake port during the withdrawal such that the solidifying material is pumped during the withdrawal and expressed through the at least one orifice to leave a substantially voidless column of solidifying material within the ground substrate.

24. The method of claim 22 wherein the drilling apparatus is an apparatus selected from the group consisting of a composite pier, a conventional helical pier, and a drilling tool; the solidifying material is a material selected from the group consisting of grout, concrete and polymer; and the at least one orifice is located directly behind a helice trailing edge in combination with a compaction fin; the helice and compaction fin being attached to the drilling apparatus shaft.

* * * * *